US006027845A

United States Patent [19]

Kinoshita et al.

[11] Patent Number: 6,027,845

[45] Date of Patent: Feb. 22, 2000

[54] ELECTROPHOTOGRAPHY PHOTOSENSITIVE ELEMENT

[75] Inventors: Akira Kinoshita; Hirofumi Hayata; Toyoko Shibata; Tomoko Suzuki, all of Tokyo, Japan

[73] Assignee: Konica Corporation

[21] Appl. No.: 09/051,762

[22] PCT Filed: Aug. 27, 1997

[86] PCT No.: PCT/JP97/02973

§ 371 Date: Apr. 16, 1998

§ 102(e) Date: Apr. 16, 1998

[87] PCT Pub. No.: WO98/09197

PCT Pub. Date: Mar. 5, 1998

[30] Foreign Application Priority Data

Aug. 27, 1996 [JP] Japan ..... 8-225199

[51] Int. Cl.[7] ..... G03G 5/06

[52] U.S. Cl. ..... 430/58.15; 430/58.25; 430/58.3

[58] Field of Search ..... 430/58, 59

[56] References Cited

U.S. PATENT DOCUMENTS 5,821,019 10/1998 Nguyen ..... 430/58

5,863,688 1/1999 Watanabe et al. ..... 430/58

*Primary Examiner*—John L Goodrow

*Attorney, Agent, or Firm*—Jordan B. Bierman; Bierman, Muserlian and Lucas

[57] ABSTRACT

An electrophotographic photoreceptor has a layered-type structure comprising an electrically conductive support having thereon a charge generating layer comprising a charge generating organic material and an electron transportable carrier transport layer comprising an electron transport organic material and a binder, and the electron transport material under a mutual molecular aggregation state of the electron transport material which results in a new adsorption component at 20 nm or more longer wavelength side than the maximum monomoleclar absorption wavelength of the electron transport material is incorporated in the electron transportable carrier transport layer and the weight ratio of the electron transport material to the binder of the electron transportable carrier transport layer ranges from 25/100 to 200/100.

According to the foregoing, it is possible to provide an electrophotographic photoreceptor which has a small residual electric potential and can assure an image contrast.

2 Claims, 5 Drawing Sheets

ELECTROPHOTOGRAPHY PHOTOSENSITIVE ELEMENT

FIELD OF THE INVENTION

The present invention relates to an electrophotographic photoreceptor for the formation of an electrostatic latent image, and more specifically to an electrophotographic photoreceptor comprising a layer containing an electron transportable compound.

BACKGROUND OF THE INVENTION

In copiers, printers, facsimile machines and the like which are based on electrophotographic technology, organic photoreceptors are widely employed which exhibit excellent advantages such as high sensitivity, small dependence on temperature and humidity, and high speed response to a semiconductor laser beam.

In such electrophotographic photoreceptors, a functionally separated structure is generally employed in that charge generating function and carrier transport function are performed by different materials. According to the structure, the range for selecting materials has been remarkably broadened. Particularly, in organic compounds, it is possible to design many branches of chemical structures and excellent materials for carrier generation and carrier transport have been developed.

As the charge generating materials, a variety of organic dyes and organic pigments have been proposed. For example, there have been known polycyclic quinone compounds represented by dibromanthanthrone, pyrylium compounds and co-crystal complexes of pyrylium compounds with polycarbonates, squarelium compounds, phthalocyanine compounds, azo compounds.

As the carrier transport materials, there have been known compounds having a heterocyclic nucleus containing a nitrogen atom and the condensed ring nucleus represented by oxazole, oxadiazole, thiazole, thiadiazole, imidazole, etc., polyarylalkane series compounds, pyrazoline series compounds, hydrazone series compounds, triarylamine series compounds, styryl series compounds, styryltriphenylamine series compounds, β-phenylstyryltriphenylamine series compounds, butadiene series compounds, haxatriene series compounds, carbazole series compounds and the like. All those carrier transport materials are capable of transporting a positive hole.

When a photoreceptor is prepared by combining a charge generating material with a carrier transport material, conventionally, it has been known that the most durable photoreceptor is prepared when a layered structure is employed in which a charge generating layer comprising the charge generating material is provided on an electrically conductive support and on the resulting layer, a carrier transport layer comprising the carrier transport material is provided.

Because the carrier transport material is capable of transporting a positive hole, in such electrophotographic photoreceptors, operation is carried out while the surface of the photoreceptor is negatively charged.

For charging, a corona discharging method is generally employed which is capable of performing high speed operation and resulting in consistent charge characteristics. The corona discharging generates ozone. In recent years, with an increase in speed of the electrophotographic process, the increase in ozone generation per unit time has been concerned. Therefore, a high durable photoreceptor has been required which adapts to a positive corona discharging process generating a small amount of ozone.

In view of the foregoing, there has been carried out development for organic photoreceptors which enables the layered structure in which an electron transportable carrier transport layer is provided as an upper layer. As the electron transport materials, there are proposed 2,4,7-trinitrofluorenone and those compounds described in Japanese Patent Publication Open to Public Inspection Nos. 1-206349, 2-214866, 5-279582, U.S. Pat. No. 5,468,583, etc.

When those electron transport materials are employed in the conventional electron transportable carrier transport layer, serious trouble is caused in carrier injection characteristics from a charge generating material. Accordingly, light response action as the electrophotographic photoreceptor is deteriorated and the excessive residual electric potential is observed. As a result, it has been impossible to obtain the electric potential contrast necessary for forming images.

DISCLOSURE OF THE INVENTION

An object of the present invention is to provide a positively chargeable electrophotographic photoreceptor which comprises an electron transportable carrier transport layer and results in a low residual electric potential capable of securing image contrast.

The electrophotographic photoreceptor is described below.

The photoreceptor of the present invention is fabricated in such a way that on an electrically conductive support, a charge generating layer comprising an organic charge generating material and an electron transportable carrier transport layer comprising an organic electron transport material and a binder are provided in this order, and the electron transport material is incorporated in the electron transportable carrier transport layer under a mutual molecular aggregation state which generates a new absorption component having a wavelength longer by 20 nm or more than the maximum absorption wavelength of the monomolecule of the electron transport material and the weight ratio of the electron transport material to a binder ranges from 25/100 to 200/100. The electron transport material represented by the general formula (A) is particularly preferred.

General formula (A)

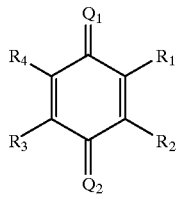

Wherein $Q_1$ and $Q_2$ each independently represents =O, =S, =N—$R_7$, =C($Z_1$) ($Z_2$). Either $R_1$ to $R_4$ and $R_7$ each independently represents a hydrogen atom, a halogen atom, a cyano group, a substituted vinyl group, a substituted or unsubstituted alkyl group, an aryl group or a heterocyclic ring. $R_1$ and $R_2$, or $R_3$ and $R_4$ respectively may be joined to form an aromatic ring or aliphatic ring. $Z_1$ and $Z_2$ each independently represents an electron attractive group.

BRIEF EXPLANATION OF THE DRAWINGS

In FIG. 1, the reference numeral 1 is an electrically conductive support, 2 is a charge generating layer, 3 is a carrier transport layer and 4 is a photosensitive layer.

DETAILED DESCRIPTION OF THE INVENTION

Figure 1:
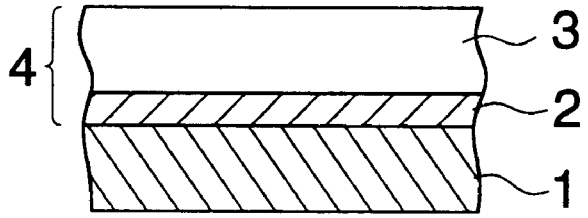
FIGS. 1(*a*), 1(*b*) and 1(*c*) each independently shows a cross section showing a construction of a representative photoreceptor.
Figure 1:
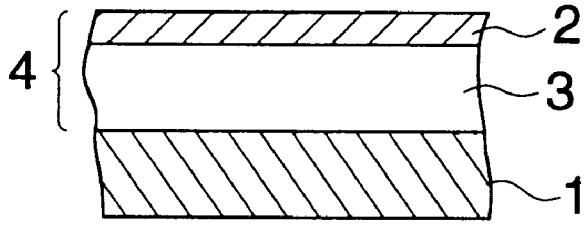
Figure 1:
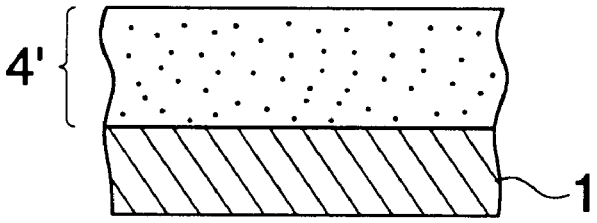

Conventionally, as photoreceptors for a positive charge process, three structures shown in FIGS. 1(*a*), 1(*b*) and 1(*c*) have been known. In the case of FIG. 1(*a*), on an electrically conductive support 1, the charge generating layer 2 is formed and the carrier transport layer 3 is provided on it to form the photoreceptor 4 and in FIG. 1(*b*), the photoreceptor 4 is fabricated by reversing those charge generating layer 2 and carrier transport layer 3. In FIG. 1(*c*), there is formed a photoreceptor 4' comprising a charge generating material and a carrier transport material. Of these, the photoreceptor shown in FIG. 1(*a*) exhibits excellent quality in durability, electric properties, especially residual electric properties at repetition.

Generally, in the carrier transport layer, the carrier transport material is uniformly incorporated in a binder under a monomolecular state. In the positively chargeable photoreceptor in FIG. 1(*a*), in the past, the electron transport material has been incorporated in a binder under a monomolecular state and the electron transportable carrier transport layer is formed. This is different from the case of a positive hole transportable carrier transport layer comprising a positive hole transport material and in the vicinity of the boundary of the charge generating layer and the carrier transport layer, electron transfer is hindered. As a result, electrons are accumulated in the vicinity of the boundary to cause a fatal residual electric potential and on account of this, no electric potential contrast necessary for imaging has been obtained.

In the present invention, at least one part of the electron transport material is incorporated in the carrier transport layer under a molecular aggregation state. Under the situation, it is estimated that the barrier against the electron transfer in the vicinity of the boundary of the charge generating layer and the carrier transport layer is removed. In the carrier transport layer of the present invention, there are two possible structural cases; one is that a molecular aggregation state is only incorporated and the other is that in the electron transport material-dissolving phase, the molecular aggregation phase of the same electron transport material is also present.

The molecular aggregation state is the state formed by the mutual cohesive force between molecules of the electron transport material and the molecular aggregation may be formed by molecules of two kinds or more of the electron transport materials.

A coating composition for the carrier transport layer is generally prepared by dissolving an electron transport material in a solvent together with a suitable binder and adding additives to the resulting composition, if desired. In order to prepare the molecular aggregation state of the present invention, after the composition such as above-mentioned is coated, it is desired that in the drying process of the solvent, the molecules are naturally brought into aggregation. However, the other methods may be employed in that after coating and drying, the coated film undergoes suitable solvent treatment to bring molecules into aggregation or particles under molecular aggregation state are add dispersed in the coating composition for the carrier transport layer and the resulting is coated.

The electron transport material is dissolved in a solvent together with a binder and is coat dried to prepare the carrier transport layer. During drying, the solvent is removed and a molecular aggregation phase is formed depending on properties of the electron transport material and binder such as solubility. Accordingly, the formation of the molecular aggregation can be adjusted through the selection of combinations of the electron transport material and binder and their amounts. Even using the same electron transport material, the aggregation may not be formed with a certain kind of binder. Those are illustrated in Examples shown below.

The molecular aggregation is confirmed, for example, with the observation employing a microscope. It may be confirmed with the observation employing a loupe having low magnification or direct observation with eyes. In some cases, the transparency of the carrier transport layer is lost by the molecular aggregation of the electron transport material which changes the layer like as a ground glass. There may be finely devided molecular aggregation which cannot be confirmed by a microscope. In this case, the advantage of the present invention is exhibited as described below.

Such the molecular aggregation state of the present invention can be confirmed by measuring the absorption spectrum of the carrier transport layer. The absorption spectrum of the monomolecular state of the electron transport material is obtained by measuring a composition prepared by dissolving compositions composed of the carrier transport layer in a solvent which can dissolve those. Spectrum thus obtained is termed Spectrum A. The spectrum of the carrier transport layer is measured employing a sample prepared by diluting the carrier transport layer coating composition with a solvent in which compositions of the layer are soluble and coating/drying the resulting composition on a glass plate with a measurable thickness. Spectrum thus measured is termed Spectrum B.

The Spectrum B of the carrier transport layer in which no molecular aggregation is formed shows basically a shape similar to the Spectrum A, though it may shifts by 10 nm or so due to the difference in the environment around it. Contrary to this, with the Spectrum B of the carrier transport layer in which the molecular aggregation is formed, the new absorption which is not observed in the Spectrum A is found in the longer wavelength region by 20 nm or more than the maximum absorption wavelength of the electron transport material observed in the Spectrum A. Accordingly, the molecular aggregation can be confirmed.

With finely divided molecular aggregation which cannot be observed by a microscope, the new absorption explained herein appears and makes it possible to confirm the molecular aggregation.

It is estimated that the molecules of the electron transport material are brought into cohedion to generate a new energy state and the new absorption is observed. Furthermore, it is estimated that according to the energy state generated by the molecular aggregation, electron injection properties vary and residual electric potential properties are improved.

Conventionally, there has been known a system in which a charge transfer complex or a thiapyrylium-polycarbonate co-crystal complex is incorporated into a positive hole transport layer in which a positive hole transport material is dissolved in a binder. In those cases, a new absorption component is occasionally observed in the wavelength region by 20 nm or longer. The former example is described in "Chem. Rev. 1993, 93, pages 449 to 486". This charge transfer complex is formed between a donor molecule and an acceptor molecule. Therefore, its structure is different from the molecular aggregation of the present invention which is formed by the electron transport material alone. The latter example is described in U.S. Pat. No. 3,615,414. This is formed between a thiapyrylium molecule and a polycarbonate molecule and in the binder other than polycarbonate, is different from the molecular aggregation of the present invention which is formed by the electron transport material alone.

There is a problem with the system into which the charge transfer complex or the thiapyrylium-polycarbonate co-crystal complex is incorporated that those have a sufficient charge generating function. When those materials are incorporated in the electron transportable carrier transport layer, a carrier is generated in the carrier transport layer upon exposure. However, the positive hole which is not movable is accumulated in the layer and causes an image memory. On account of this, it is necessary to have a positive hole transport function by dissolving a sufficient amount of the positive hole transport material. This induces the decrease in the layer strength.

There is no such the problem for the molecular aggregation of the present invention because the charge generating function is small. Accordingly, there is no need to add a positive hole transportability, and no decrease in the layer strength is caused.

In order to form the molecular aggregation state of the electron transport material, it is important to select a binder which adapts to the electron transport material. Furthermore, the ratio of the electron transport material to the binder is important. In a combination of the electron transport material with the binder, the molecular aggregation state of the present invention is formed. In the carrier transport layer, there are occasionally both an ordinary monomolecular dissolution state part, a non-aggregation phase and a molecular aggregation deposition part, a molecular aggregation phase. In this case, in the molecular aggregation phase, both carrier injection properties from the charge generating material and carrier transfer properties are improved.

In order to accomplish the object of the present invention, the ratio of the electron transport material to the binder in the electron transportable carrier transport layer is preferably set up at 25/100 by weight or more. Particularly, it is preferably set up at 30/100 or more. On the other hand, in order to obtain the sufficient strength of an electrophotographic photoreceptor layer, it is desired to use usually in the concentration range of 200/100 or less.

In the electron transportable carrier transport layer of the present invention, though it may have positive hole transport capability, it is referred to one in that the electron transport capability is superior to the positive hole transport capability. The positive hole and electron transport capabilities are determined by comparing light sensitivity under an operation mode dominated by positive hole transport to light sensitivity under an operation mode dominated by electron transport upon preparing an electrophotographic photoreceptor having combinations of charge generating materials. For example, when a photoreceptor is prepared by placing a charge generating layer and a carrier transport layer in this order on an electrically conductive support, the light sensitivity under a positively charged mode, for example, a half-decrease exposure amount represents the electron transport capability and the light sensitivity under a negatively charged mode represents the positive hole transport capability. Therefore, a case in which the light sensitivity under the positively charged mode is greater is referred to electron transport domination.

In the present invention, as the electron transport material employed for the formation of the electron transportable carrier transport layer, any material can be employed and a plurality of the materials may be employed at the same time. Representatively, those represented by the general formulas (A) to (D) are advantageous and particularly in compounds represented by the general formula (A), a uniform and even molecular aggregation layer is formed and a photoreceptor generating quality images is readily prepared. Specific examples of those are shown below.

General formula (A)

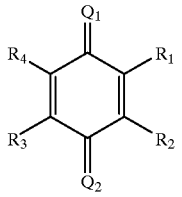

General formula (B)

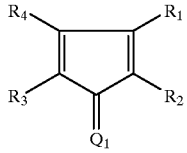

General formula (C)

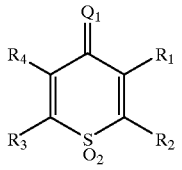

General formula (D)

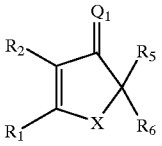

wherein X represents $>SO_2$, $>C{=}Q_2$, and $Q_1$ and $Q_2$ each independently represents $=O$, $=S$, $=N{-}R_7$, or $=C(Z_1)(Z_2)$. $R_1$ and $R_2$, or $R_3$ and $R_4$ each may be jointed each other to form an aromatic ring or aliphatic ring and $R_5$ and $R_6$ each may have a structure of $=N{-}R_7$ or $=C(R_8)(R_9)$. $Z_1$ and $Z_2$ each independently represents an electron attractive group.

$R_1$ to $R_9$ each independently represents a hydrogen atom, a halogen atom, a cyano group, a substituted vinyl group, a substituted or unsubstituted alkyl group, aryl group, heterocyclic ring.

The preferred substituent of the substituted vinyl group is a phenyl, cyano or alkoxycarbonyl group. The preferred alkyl group is one having from 1 to 20 carbon atoms and the preferred aryl group is benzene, naphthalene or pyrene. The preferred heterocyclic ring group is pyridine, thiophene, quinoline or oxazole. The preferred substituent of the alkyl group, aryl group and heterocyclic ring is an alkoxy, vinyl, phenyl, alkyl, trifluoromethyl, cyano, amino, alkylamino, arylamino, nitro, alkoxycarbonyl, acyl, styryl, alkylcarbamide, alkylsulfonamide or carbamoyl group or a halogen atom. The preferred electron attractive group is a cyano, nitro, trifluoromethyl, alkoxycarbonyl, acyl, aryloxycarbonyl, sulphone, or a phenyl or naphthyl group substituted with any of those groups or a halogen atom.

In the general formulas (A), (B) and (C), all of $R_1$, $R_2$, $R_3$ and $R_4$ are preferably not hydrogen atoms at the same time. Furthermore, in the general formula (D), all of $R_1$, $R_2$, $R_5$ and $R_6$ are preferably not hydrogen atoms at the same time.

Examples of compounds represented by the general formula (A)

| No. | $Q_1$ | $Q_2$ | $R_1$ | $R_2$ | $R_3$ | $R_4$ |
|---|---|---|---|---|---|---|
| A-1 | =O | =O | H | 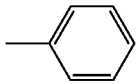 | 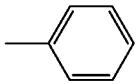 | H |
| A-2 | =O | =O | H | 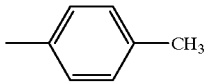 | 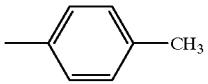 | 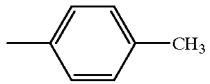 |
| A-3 | =O | =O | 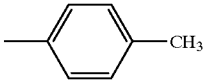 | 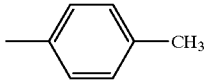 | 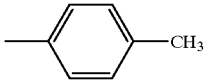 | 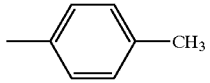 |
| A-4 | =O | =O | Cl | 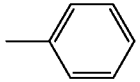 | 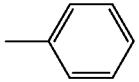 | H |
| A-5 | =N—CN | =O | H | 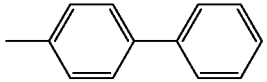 | 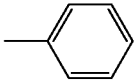 | H |
| A-6 | =N—CN | =O | H | 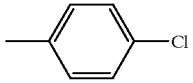 | 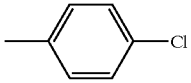 | H |

-continued
| No. | $Q_1$ | $Q_2$ | $R_1$ | $R_2$ | $R_3$ | $R_4$ |
|---|---|---|---|---|---|---|
| A-7 | 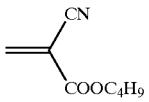 | =O | H | 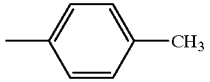 | 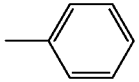 | H |
| A-8 | 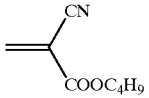 | =O | H | 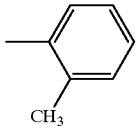 | 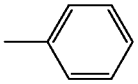 | H |
| A-9 | 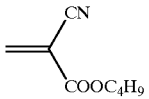 | =O | H | 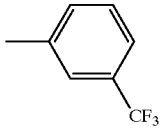 | 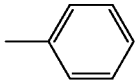 | H |
| A-10 | 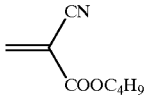 | =O | H | 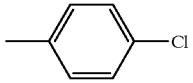 | 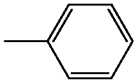 | H |
| A-11 | 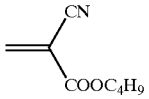 | =O | H | 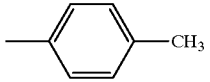 | 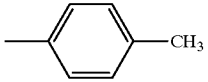 | H |
| A-12 | 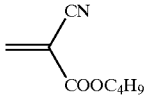 | =O | H | 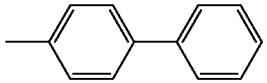 | 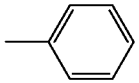 | H |
| A-13 | 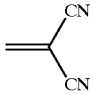 | =O | H | 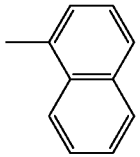 | 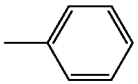 | H |

-continued
| No. | $Q_1$ | $Q_2$ | $R_1$ | $R_2$ | $R_3$ | $R_4$ |
|---|---|---|---|---|---|---|
| A-14 | 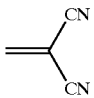 | =O | H | $-C_4H_9$ | $-C_4H_9$ | H |
| A-15 | 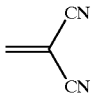 | =O | H | 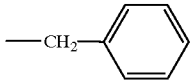 | 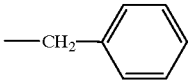 | H |
| A-16 | 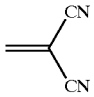 | =O | H | 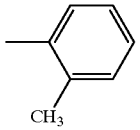 | 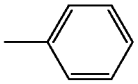 | H |
| A-17 | 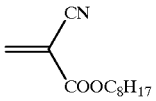 | =O | H | 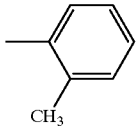 | 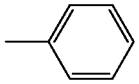 | H |
| A-18 | 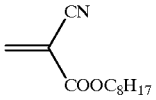 | =O | H | 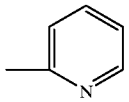 | 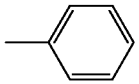 | H |
| A-19 | 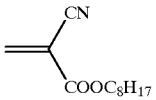 | =O | H | 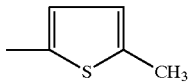 | 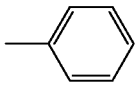 | H |
| A-20 | 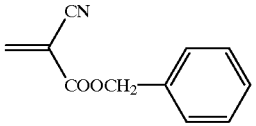 | =O | H | 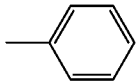 | 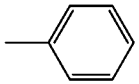 | H |

-continued
| No. | $Q_1$ | $Q_2$ | $R_1$ | $R_2$ | $R_3$ | $R_4$ |
|---|---|---|---|---|---|---|
| A-21 | 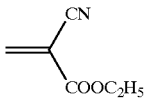 | =O | H | 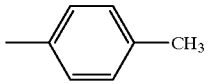 | 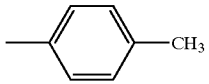 | H |
| A-22 | 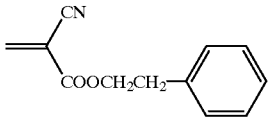 | =O | H | 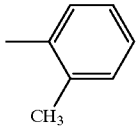 | 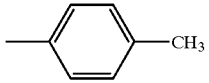 | H |
| A-23 | 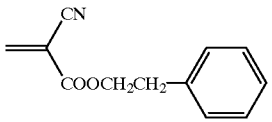 | =O | H | 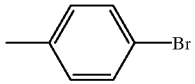 | 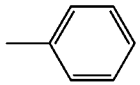 | H |
| A-24 | 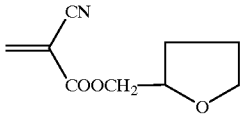 | =O | H | 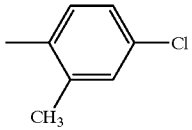 | 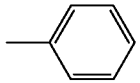 | H |
| A-25 | 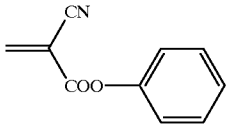 | =O | H | 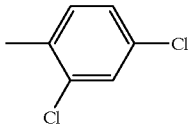 | 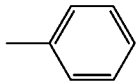 | H |
| A-26 | 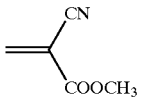 | =O | H | 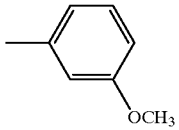 | 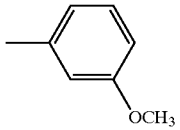 | H |
| A-27 | 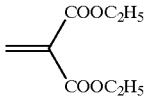 | =O | H | 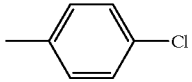 | 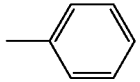 | H |

-continued
| No. | $Q_1$ | $Q_2$ | $R_1$ | $R_2$ | $R_3$ | $R_4$ |
|---|---|---|---|---|---|---|
| A-28 | 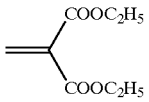 | =O | H | $-CH_3$ | $-CH_3$ | H |
| A-29 | 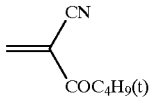 | =O | H | 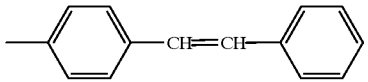 | 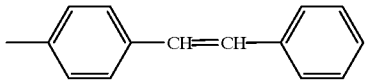 | H |
| A-30 | 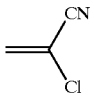 | =O | H | 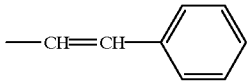 | 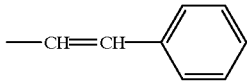 | H |
| A-31 | 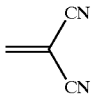 | 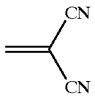 | H | $-CH_3$ | H | $-CH_3$ |
| A-32 | 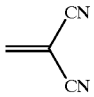 | 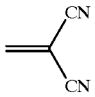 | H | H | H | H |
| A-33 | =O | =O | | 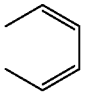 | $-CH_3$ | H |
| A-34 | =O | =O | | 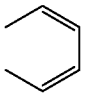 | 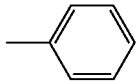 | H |
| A-35 | =O | =O | | 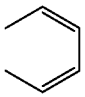 | 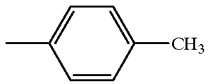 | 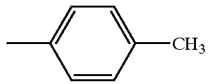 |

-continued
| No. | $Q_1$ | $Q_2$ | $R_1$ | $R_2$ | $R_3$ | $R_4$ |
|---|---|---|---|---|---|---|
| A-36 | =O | =O | | 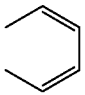 | 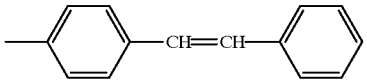 | H |
| A-37 | =O | =O | | 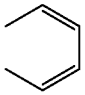 | 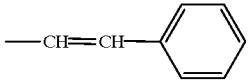 | H |
| A-38 | =N—CN | =O | | 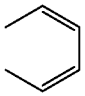 | 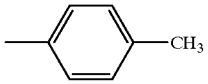 | H |
| A-39 | =N—CN | =O | | 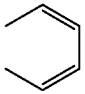 | 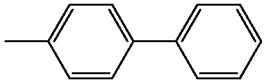 | H |
| A-40 | =N—CN | =O | | 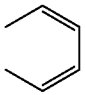 | 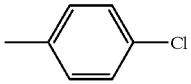 | H |
| A-41 | =N—CN | =N—CN | | 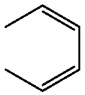 | 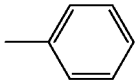 | H |
| A-42 | =N—CN | =N—CN | | 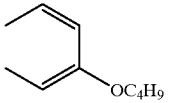 | H | H |
| A-43 | =N—CN | =N—CN | | 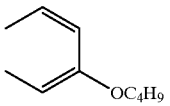 | 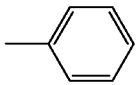 | H |

-continued
| No. | $Q_1$ | $Q_2$ | $R_1$ | $R_2$ | $R_3$ | $R_4$ |
|---|---|---|---|---|---|---|
| A-44 | 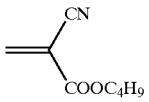 | =O | | 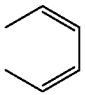 | 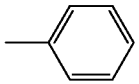 | H |
| A-45 | 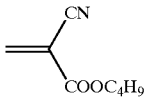 | =O | | 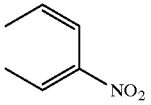 | 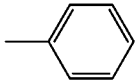 | H |
| A-46 | 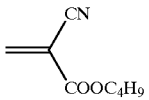 | =O | | 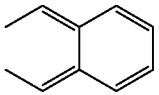 | 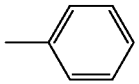 | H |
| A-47 | 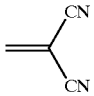 | =O | | 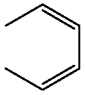 | 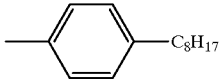 | H |
| A-48 | 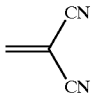 | =O | | 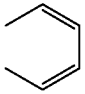 | 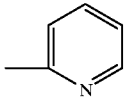 | H |
| A-49 | =O | =O | | 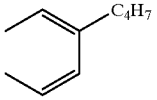 | 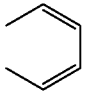 | |
| A-50 | =O | =O | | 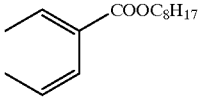 | 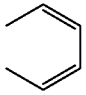 | |

-continued
| No. | $Q_1$ | $Q_2$ | $R_1$ | $R_2$ | $R_3$ | $R_4$ |
|---|---|---|---|---|---|---|
| A-51 | =O | =O | | 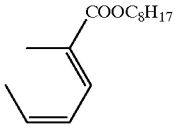 | | 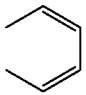 |
| A-52 | =N—CN | =O | | 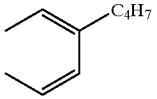 | | 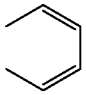 |
| A-53 | =N—CN | =O | | 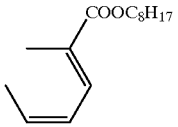 | | 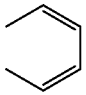 |
| A-54 | =N—CN | =O | | 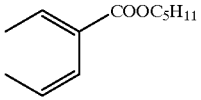 | | 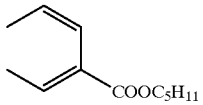 |
| A-55 | =N—CN | =N—CN | | 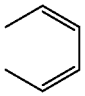 | | 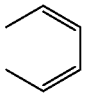 |

-continued
| No. | $Q_1$ | $Q_2$ | $R_1$ | $R_2$ | $R_3$ | $R_4$ |
|---|---|---|---|---|---|---|
| A-56 | 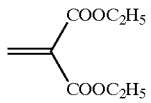 | =O | | 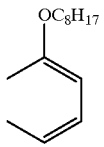 | | 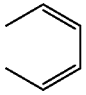 |
| A-57 | 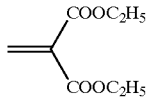 | 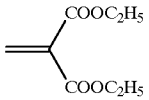 | | 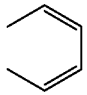 | | 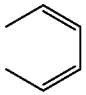 |
| A-58 | =O | =O | | 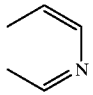 | | 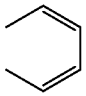 |
| A-59 | =O | =O | | 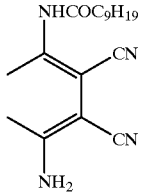 | | 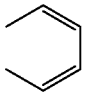 |

-continued
| No. | $Q_1$ | $Q_2$ | $R_1$ | $R_2$ | $R_3$ | $R_4$ |
|---|---|---|---|---|---|---|
| A-60 | 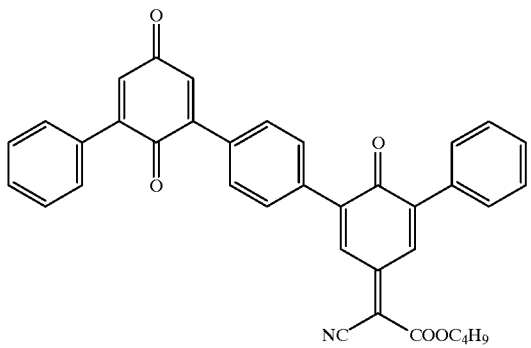 | | | | | |
| A-61 | 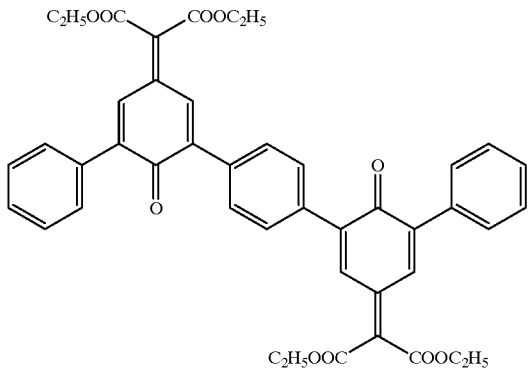 | | | | | |

Examples of compounds represented by the general formula (B)

| No. | $Q_1$ | $R_1$ | $R_2$ | $R_3$ | $R_4$ |
|---|---|---|---|---|---|
| B-1 | =O | 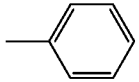 | 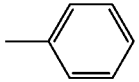 | 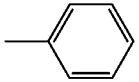 | 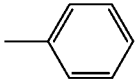 |
| B-2 | =S | 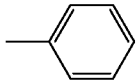 | 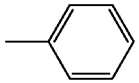 | 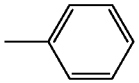 | 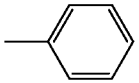 |
| B-3 | =N—CN | 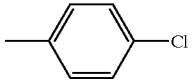 | 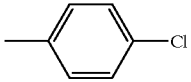 | 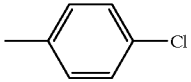 | 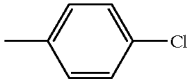 |
| B-4 | =N—CN | 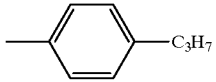 | H | H | 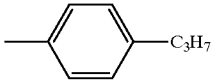 |
| B-5 | =N—CN | 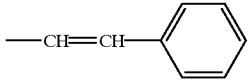 | H | H | 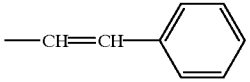 |
| B-6 | 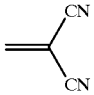 | 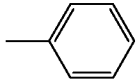 | 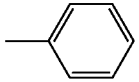 | 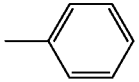 | 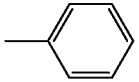 |
| B-7 | 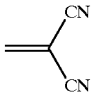 | 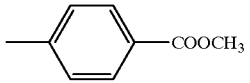 | 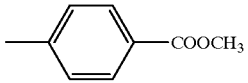 | 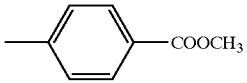 | 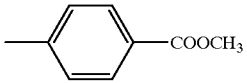 |
| B-8 | 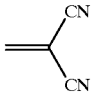 | 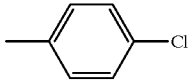 | 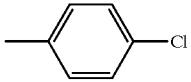 | 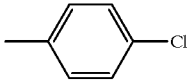 | 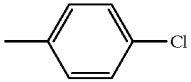 |

-continued
| No. | $Q_1$ | $R_1$ | $R_2$ | $R_3$ | $R_4$ |
|---|---|---|---|---|---|
| B-9 | 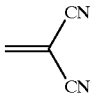 | 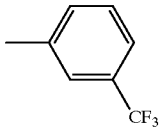 | 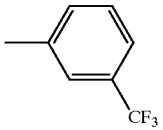 | 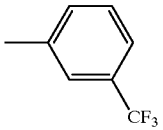 | 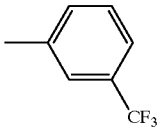 |
| B-10 | =O | | 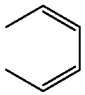 | 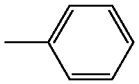 | 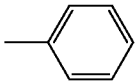 |
| B-11 | =O | | 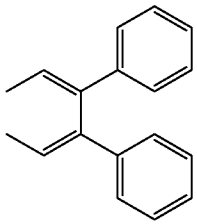 | 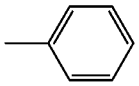 | 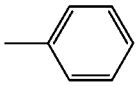 |
| B-12 | 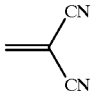 | | 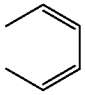 | 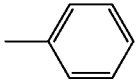 | 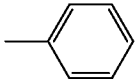 |
| B-13 | 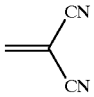 | | 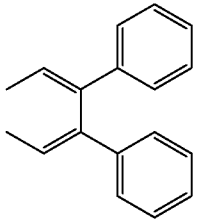 | 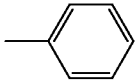 | 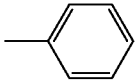 |

-continued
| No. | $Q_1$ | $R_1$ | $R_2$ | $R_3$ | $R_4$ |
|---|---|---|---|---|---|
| B-14 | 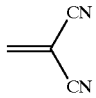 | | 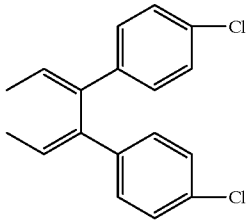 | 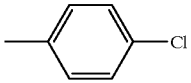 | 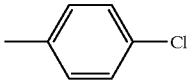 |
| B-15 | 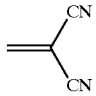 | | 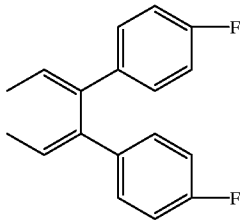 | 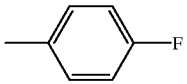 | 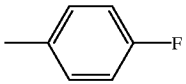 |
| B-16 | =N—CN | | 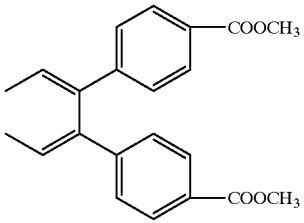 | 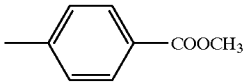 | 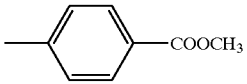 |
| B-17 | =N—CN | | 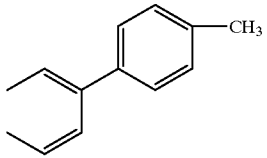 | 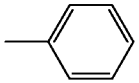 | 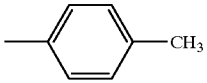 |
| B-18 | =N—CN | | 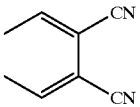 | 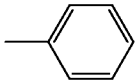 | 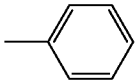 |

-continued
| No. | $Q_1$ | $R_1$ | $R_2$ | $R_3$ | $R_4$ |
|---|---|---|---|---|---|
| B-19 | 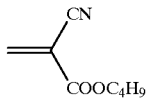 | | 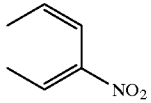 | 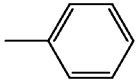 | 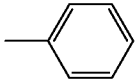 |
| B-20 | 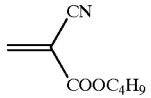 | | 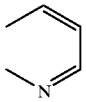 | 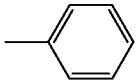 | 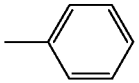 |
| B-21 | =O | | 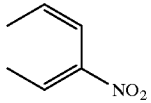 | | 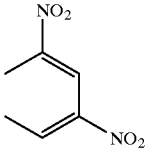 |
| B-22 | 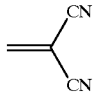 | | 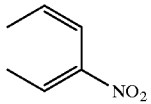 | | 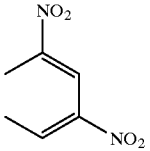 |
| B-23 | 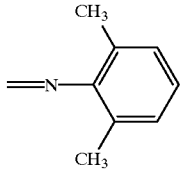 | | 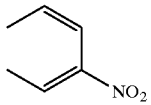 | | 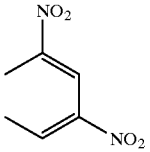 |
| B-24 | 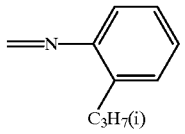 | | 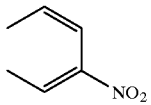 | | 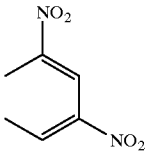 |

-continued
| No. | $Q_1$ | $R_1$ | $R_2$ | $R_3$ | $R_4$ |
|---|---|---|---|---|---|
| B-25 | 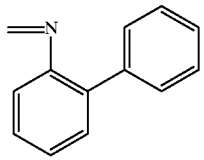 | | 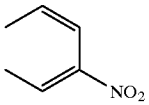 | | 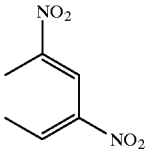 |
| B-26 | =S | | 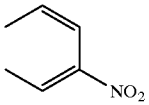 | | 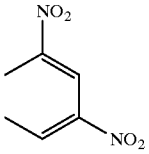 |
| B-27 | =O | | 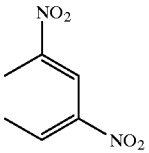 | | 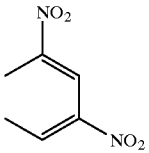 |
| B-28 | 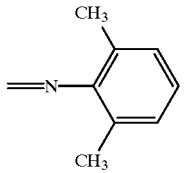 | | 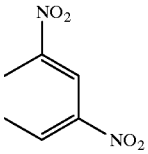 | | 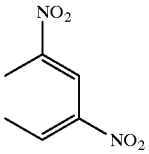 |

-continued
| No. | $Q_1$ | $R_1$ | $R_2$ | $R_3$ | $R_4$ |
|---|---|---|---|---|---|
| B-29 | 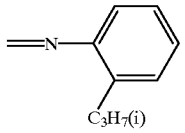 | | 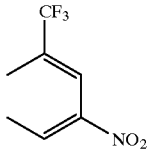 | | 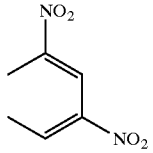 |
| B-30 | 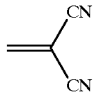 | | 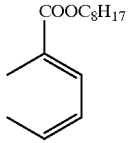 | | 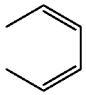 |
| B-31 | 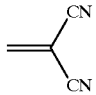 | | 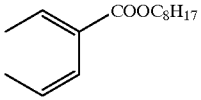 | | 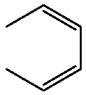 |
| B-32 | 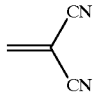 | | 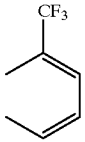 | | 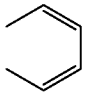 |

Examples of compounds represented by the general formula (C)
| No. | $Q_1$ | $R_1$ | $R_2$ | $R_3$ | $R_4$ |
|---|---|---|---|---|---|
| C-1 | =O | H | 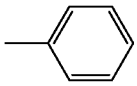 | 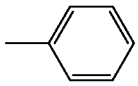 | H |
| C-2 | =O | —$COOC_4H_9$ | 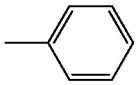 | 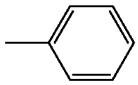 | —$COOC_4H_9$ |
| C-3 | 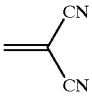 | H | 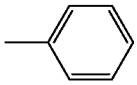 | 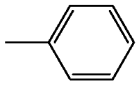 | H |
| C-4 | 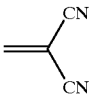 | H | 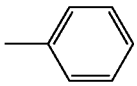 | 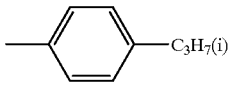 | H |
| C-5 | 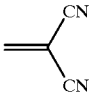 | H | 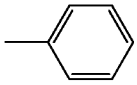 | 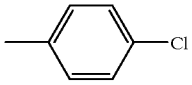 | H |
| C-6 | 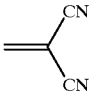 | H | 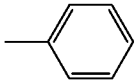 | 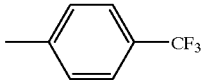 | H |
| C-7 | 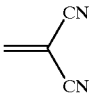 | H | 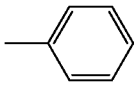 | 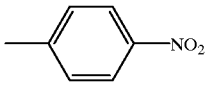 | H |
| C-8 | =N—CN | H | 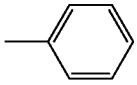 | 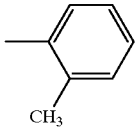 | H |
| C-9 | =N—CN | H | 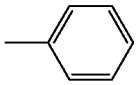 | 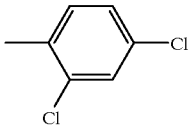 | H |
| C-10 | 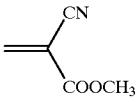 | H | 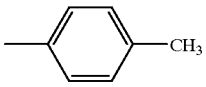 | 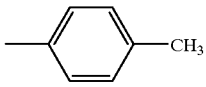 | H |
| C-11 | 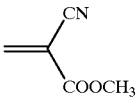 | H | 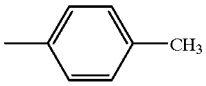 | 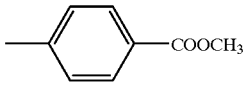 | H |

Example of compound represented by the general formula(D)

| No | $Q_1$ | X | $R_1$ | $R_2$ | $R_5$ | $R_6$ |
|---|---|---|---|---|---|---|
| D-1 | =O | $SO_2$ | | | | $—CH_3$ |
| D-2 | CN, CN | $SO_2$ | | | $—CH_3$ | $—CH_3$ |
| D-3 | CN, CN | C, CN, CN | | | | |
| D-4 | CN, CN | C, CN, CN | Cl | Cl | $—CH_3$ | |
| D-5 | CN, CN | $SO_2$ | | | H | |
| D-6 | CN, CN | $SO_2$ | | | H, C, $C_3H_7$(i) | |
| D-7 | CN, CN | $SO_2$ | | | C | |
| D-8 | =N—CN | $SO_2$ | | | $—CH_3$ | $—CH_3$ |
| D-9 | =N—CN | $SO_2$ | $NO_2$ | | H | $—C_4H_9$ |
| D-10 | CN, CN | C, CN, CN | | | H | |
| D-11 | CN, CN | C, CN, CN | | | H | $—CH_2CH=CH_2$ |
| D-12 | CN, CN | C, CN, CN | | | $—CH_3$ | $—CH_2$ |

-continued

| No | $Q_1$ | X | $R_1$ | $R_2$ | $R_5$ | $R_6$ |
|---|---|---|---|---|---|---|
| D-13 | 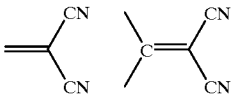 | | 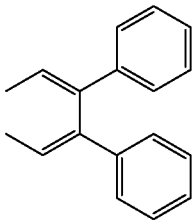 | | 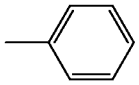 | H |
| D-14 | 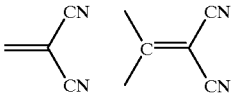 | | 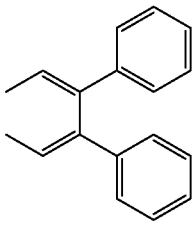 | | 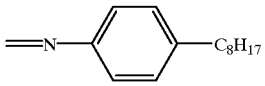 | |
| D-15 | 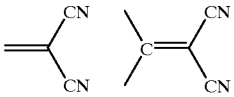 | | 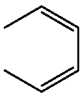 | | 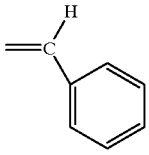 | |
| D-16 | =O | 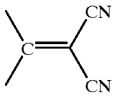 | 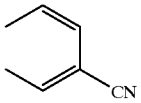 | | 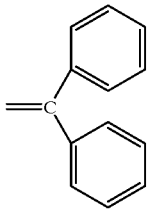 | |

The photoreceptor of the present invention is formed in a multilayered construction in which a charge generating layer and a carrier transport layer are arranged in this order on an electrically conductive support. An interlayer may be provided between the charge generating layer and the electrically conductive layer. Furthermore, a protective layer may be provided on the uppermost layer.

As the electrically conductive support, there can be employed those in which an electrically conductive compound such as a metal plate, a metal drum, an electrically conductive polymer and indium oxide, etc., or metal thin layer such as aluminum, palladium, etc. is provided on a substrate such as paper, plastic film, etc. by means of coating, vaporization, lamination, etc.

For the formation of the charge generating layer, methods are employed in which a coating composition prepared in advance is coated by a dip coating, spray coating, bar coating, roll coating, blade coating, applicator coating, etc. and dried or vacuum evaporation is employed. The coating composition for the charge generating layer is prepared by dispersing finely a charge generating material alone or together with a binder or other additives into a dispersion medium employing a dispersion apparatus such as an ultrasonic dispersion apparatus, ball mill, sand mill, homogenizing mixer or the like and the resulting composition is coated to prepare the charge generating layer.

A coating composition for the carrier transport layer is generally prepared by dissolving an electron transport material together with a suitable binder in a solvent and adding additives, etc. to the resulting composition, if desired. In order to prepare the molecular aggregation of the present invention, after coating such the composition, in the solvent drying process, it is desired that the molecules are naturally brought into aggregation. However, methods may be employed in that after coating and drying, the coated layer undergoes suitable solvent treatment to bring molecules into aggregation or particles under molecular aggregation state are add dispersed in the coating composition for the carrier transport layer and coated.

As the solvent employed for coating, there can be illustrated, for example, acetone, methyl ethyl ketone, cyclohexanone, tetrahydrofuran, dioxane, ethyl acetate, butyl acetate, methyl cellosolve, ethyl cellosolve, ethylene glycol dimethyl ether, toluene, xylene, acetophenone, chloroform, dichloromathane, dichloroethane, trichloroethane, methanol, ethanol, butanol, etc.

As the binder which can be employed for the formation of the charge generating layer or carrier transport layer, those of the following can be illustrated.

Polycarbonate
polycarbonate Z resin
acrylic resin
methacrylic resin
polyvinyl chloride
polyvinylidene chloride
polystyrene
styrene-butadiene copolymer
polyvinyl acetate
polyvinyl formal
polyvinyl butyral
polyvinyl acetal
polyvinyl carbazole
styrene-alkyd resin
silicone resin
silicone-alkyd resin
polyester
phenol resin
polyurethane
epoxy resin
vinylidene chloride-acrylonitrile copolymer
vinyl chloride-vinyl acetate copolymer
vinyl chloride-vinyl acetate-maleic anhydride copolymer The ratio of the binder to the charge generating material ranges preferably from 1/9 to 9/1 by weight and ranges more preferably from 1/2 to 6/1 by weight.

The thickness of the charge generating layer ranges preferably from 0.01 to 20 μm and more preferably from 0.05 to 5 μm. The thickness of the carrier transport layer ranges from 1 to 100 μm and ranges preferably from 5 to 40 μm.

As the binders employed for the interlayer, protective layer, etc., those illustrated for the above-mentioned charge generating layer and carrier transport layer can be employed and other than those, there are effectively employed a polyamide resin, a nylon resin, an ethylene series resin such as an ethylene-vinyl acetate copolymer, an ethylene-vinyl acetate-maleic acid anhydride copolymer, an ethylene-vinyl acetate-methacrylic acid copolymer, polyvinyl alcohol, cellulose derivatives. Furthermore, setting type binders which make use of thermo-setting or chemical-setting can be employed.

Furthermore, with the object of the improvement in electric potential properties, keeping quality, durability and environmental dependence, a variety of additives can be incorporated in the above-mentioned photoreceptor, and a positive hole transport material may be incorporated in it.

EXAMPLE

In the following, the present invention is explained in detail with reference to Examples. "Parts" described below are "by weight".

Example 1

On aluminum-sputtered PET film, a dispersion prepared by dispersing one part of titanylphtharocyanine having peaks at 9.5°, 24.1°, 27.2° of the Bragg angle 2θ under X ray diffraction, 0.5 part of silicone-butyral resin and 50 parts of methyl isopropyl ketone as a dispersion medium employing a sand mill was coated employing a wire bar, and a charge generating layer having a thickness of 0.4 μm was formed. On the other hand, 25 parts and 40 parts of an electron transport material A were dissolved in 100 parts of polystyrene resin, Styrone 679 manufactured by Asahi Chemical Industries Co., Ltd. and 700 parts of tetrahydrofuran and two kinds of carrier transport layer coating compositions were prepared. Each of them was coated employing a doctor blade so as to obtain a dried thickness of 23 μm and dried. Thus two kinds of photoreceptors were prepared. The molecular aggregation was confirmed in both of them. Those are termed Sample 1a and Sample 1b, respectively.

Figure 2:
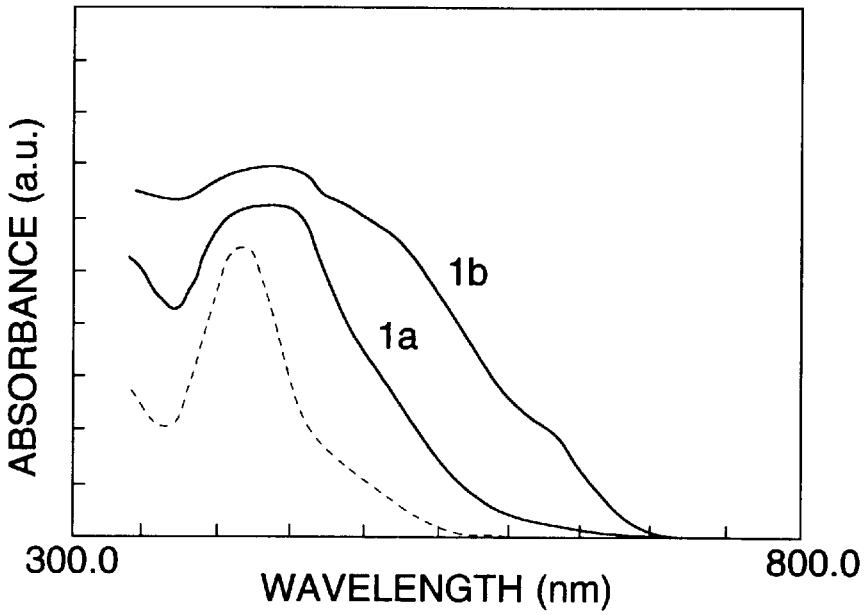
FIG. 2 shows absorption spectra of a carrier transport layer.

The absorption spectrum of the carrier transport layer was measured as follows. The carrier transport layer coating composition was diluted with a coating solvent and coated on a glass plate. The absorption spectrum of the coated glass plate was then measured by a spectrophotometer UV-3100 manufactured by Shimadzu Corp. The spectrum of a monomolecular-dissolved state of the carrier transport layer was measured by diluting the carrier transport layer coating composition with tetrahydrofuran. FIG. 2 shows the results. The broken line shows the spectrum of the monomolecular-dissolved state.

Figure 3:
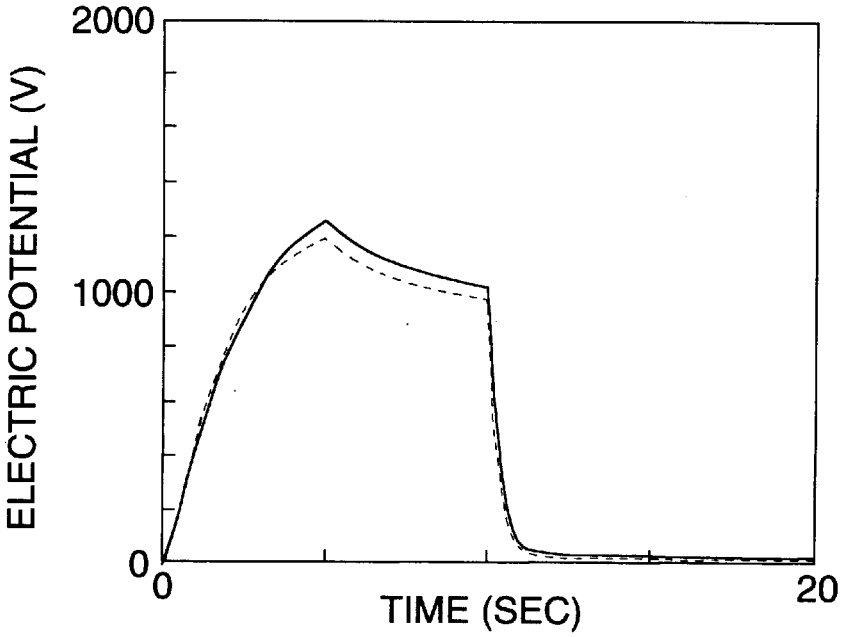
FIG. 3 is a time chart of a surface electric potential of a carrier transport layer.

Furthermore, the prepared photoreceptor was evaluated employing an electrostatic copying evaluation apparatus PA-8100 manufactured by Kawaguchi Electric Co. At first, it was subjected to +6 kV corona discharging for 5 seconds and was left in a dark place for 5 seconds. Thereafter, it was irradiated with a white light having an illuminance of 100 lux for 10 seconds. The measurement was expressed as the time chart of the surface electric potential of the photoreceptor. In such the time chart, an electric potential which remains till the end in the time chart is termed a residual electric potential. FIG. 3 shows the results. The solid line shows the Sample 1a and the broken line shows the Sample 1b.

Comparative Example 1

Figure 4:
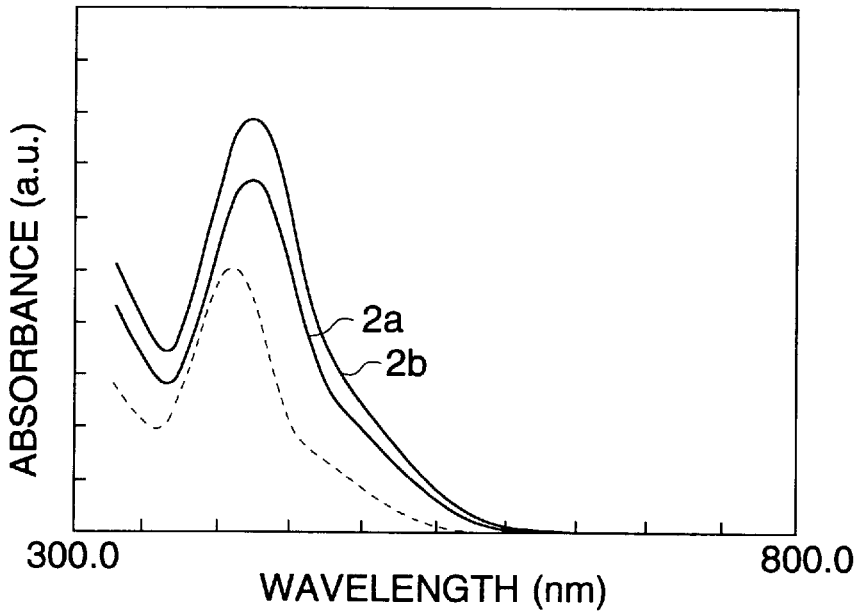
FIG. 4 shows absorption spectra of a carrier transport layer.

Two kinds of comparative photoreceptors were prepared in the same manner as in Example 1 except that the binder of the carrier transport layer coating composition was replaced with a polycarbonate resin, Upiron Z-200 manufactured by Mitsubishi Gas Chemical Co., Ltd. Those are termed Comparative Sample 1a and Comparative Sample 2b. FIG. 4 shows the absorption spectra of the carrier transport layer measured in the same manner as in Example 1. The broken line shows the spectrum of the monomolecular-dissolved state.

Figure 5:
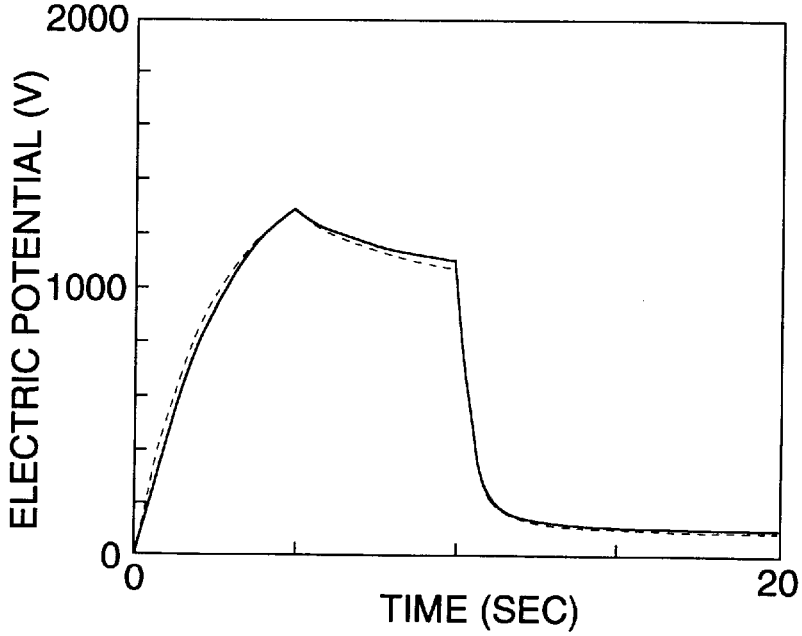
FIG. 5 is a time chart of a surface electric potential of a photoreceptor.

The prepared photoreceptors were also evaluated in the same manner as in Example 1 and FIG. 5 shows the results. The solid line shows the Comparative Sample 1a and the broken line shows the Comparative Sample 1b.

In Example 1, with the absorption spectra (FIG. 2), the monomolecular maximum absorption wavelength is 409 nm. On the other hand, with the absorption spectrum of the carrier transport layer, in the case of 25 parts of the electron transport material (curve 1a), an absorption component due to the molecular aggregation is observed at 450 nm and in the case of 40 parts (curve 1b), a few absorption components due to the molecular aggregation are observed in the longer wavelength region.

On the other hand, in Comparative Example 1 in which the binder is changed, no molecular aggregation is observed. With the absorption spectra (FIG. 4), the maximum monomolecular absorption wavelength is 409 nm. However, in both cases of 25 parts and 40 parts of the electron transport material, the shift to 422 nm is only observed and no new absorption component was found. It is estimated that the shift of a wavelength of 13 nm is caused by the difference in the medium around the electron transport material. It is also estimated that the binder is more soluble to the electron transport material A-11 than the binder employed in Example 1.

When FIG. 3 is compared to FIG. 5, the effect to decrease the residual electric potential is observed for the formation of the molecular aggregation.

Example

On the charge generating layer prepared in Example 1, three kinds of carrier transport layer coating compositions were coated which were prepared by dissolving 10, 20 and 30 parts of the electron transport material A-60 in a mixture consisting of 100 parts of polycarbonate resin, Upiron Z-200 and 700 parts of tetrahydrofuran. The resulting compositions were coat dried employing a doctor blade so as to form a dried layer thickness of 18 $\mu$m and three kinds of photoreceptors were prepared. Those were termed Comparative Sample 2a, Comparative Sample 2c and Inventive Sample 2c, respectively.

Figure 6:
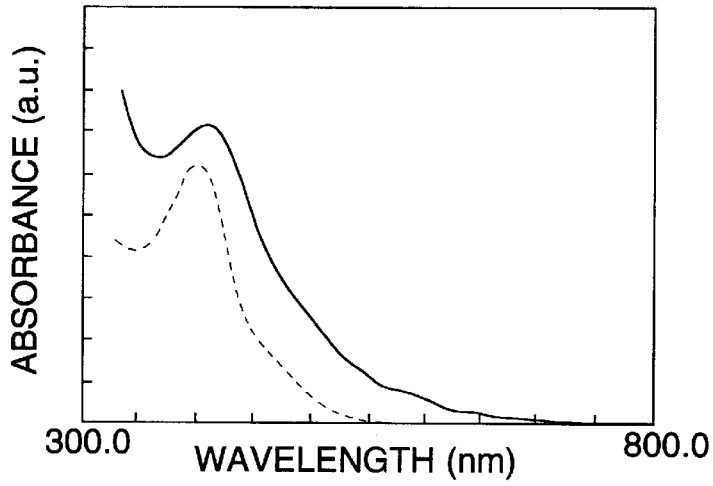
FIGS. 6(*a*), 6(*b*) and 6(*c*) each independently shows absorption spectra of a carrier transport layer.
Figure 6:
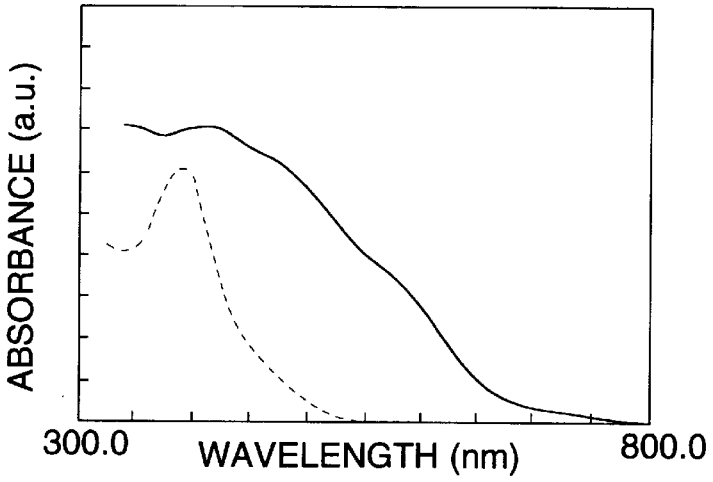
Figure 6:
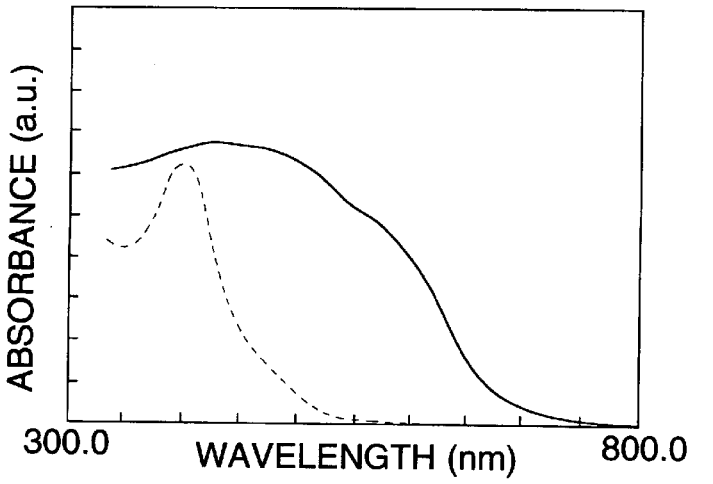

FIGS. 6(*a*) to 6(*c*) show spectra of the carrier transport layers measured in the same manner as in Example 1. The broken lines show the spectra of the monomolecular-dissolved state.

Figure 7:
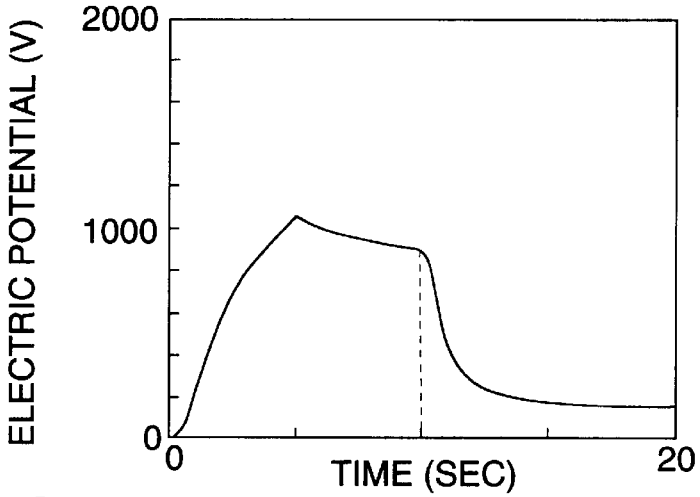
FIGS. 7(*a*), 7(*b*) and 7(*c*) each independently is a time chart of a surface electric potential of a photoreceptor.
Figure 7:
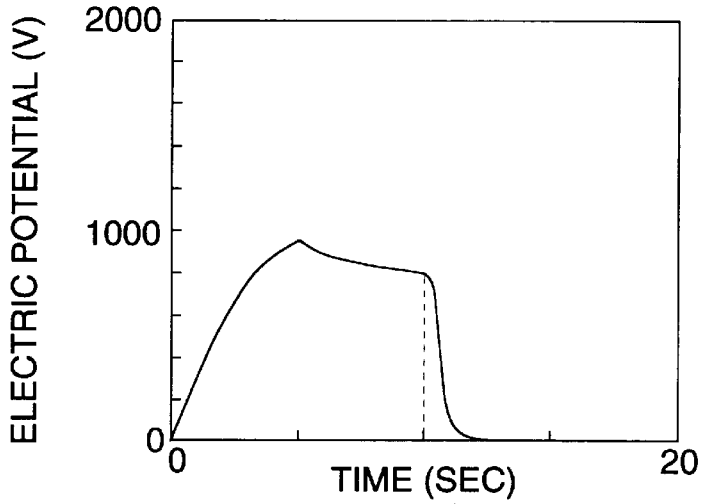
Figure 7:
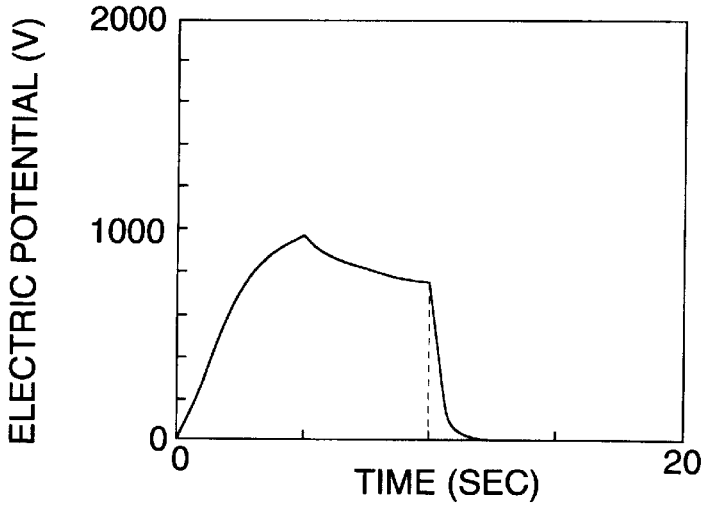

Prepared photoreceptors were evaluated in the same manner as in Example 1. FIGS. 7(*a*) to 7(*c*) show the results.

In Example 2, with the absorption spectra (FIG. 6), the maximum monomolecular absorption wavelength is 397 nm. On the other hand, with the spectrum of the carrier transport layer in the case of 10 parts of the electron transport material (FIG. 6(*a*)), the maximum absorption wavelength is 404 nm and the shift of a wavelength of 7 nm shows that the most part is in the monomolecular state but the absorption component due to the molecular aggregation is slightly observed in the longer wavewength region. In the cases of 20 parts (FIG. 6(*b*)) and 30 parts (FIG. 6(*c*)), absorption components due to the molecular aggregation are observed.

With the photoreceptor properties (FIG. 7), in the case of 10 parts of the electron transport material (FIG. 7(*a*)), almost no effect for the decrease in the residual electric potential is obtained because the molecular aggregation is not fully formed and S-letter type phenomenon of a light decay curve is observed. In the case of 20 parts (FIG. 7(*b*)), because the molecular aggregation is fully formed, the effect for the decrease in the residual electric potential is obtained. However, on account of the low concentration of the electron transport material, the light decay curve is not drawn as a sharp decay curve but as a S-letter type. Thus, no practically available properties are obtained. In the case of 30 parts (FIG. 7(*c*)), the S-letter type phenomenon disappears and the effect for the remarkable decrease in the residual electric potential is observed.

Example 3

In Example 1, the photoreceptors were prepared employing 80 weight parts and 150 weight parts of the electron transport material A-11 and the properties were evaluated. Good properties showing no residual electric potential were obtained.

As is clearly shown in the above examples, the effect for the remarkable decrease in the residual electric potential is obtained by forming the molecular aggregation through the selection of the binder. Furthermore, by making the ratio of the electron transport material to the binder 25/100 or more, the formation of the S-letter type light decay curve can be avoided and an excellent electrophotographic photoreceptor is obtained.

Industrial Application

According to the present invention, it is possible to provide an electrophotographic photoreceptor which has an electron transportable carrier transport layer, exhibits a small residual electric potential and is capable of securing an image contrast.

What is claimed is:

1. A layered-type electrophotographic photoreceptor comprising an electrically conductive support having thereon a charge generating layer, comprising a charge generating organic material, and an electron transportable carrier transport layer, comprising an electron transport organic material and a binder, in this order, wherein said electron transport material aggregates mutually in said binder whereby a new absorption component is generated at a wavelength which is at least 20 nm longer than a maximum absorption wavelength of said electron transport material is molecularly dispersed of said electron transportable carrier transport layer, and a weight ratio of said electron transport material to said binder of said electron transportable carrier transport layer ranges from 25/100 to 200/100.

2. An electrophotographic photoreceptor of claim 1 wherein the electron transport material is represented by the general formula (A).

General formula (A)

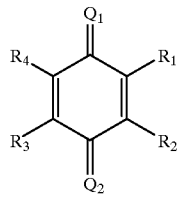

wherein $Q_1$ and $Q_2$ each independently represents =0, =S, =N—$R_7$, =C($Z_1$) ($Z_2$). $R_1$ to $R_4$ and $R_7$ each independently represents a hydrogen atom, a halogen atom, a cyano group, a substituted vinyl group, an substituted or unsubstituted alkyl, aryl group or heterocyclic ring. $R_1$ and $R_2$, or $R_3$ and $R_4$ may be jointed together to form an aromatic ring or aliphatic ring. $Z_1$ and $Z_2$ each independently represents an electron attractive group.

* * * * *